United States Patent [19]

Rotem

[11] Patent Number: 4,533,412

[45] Date of Patent: Aug. 6, 1985

[54] THERMAL-MECHANICAL TREATMENT FOR COPPER ALLOYS

[75] Inventor: Abraham I. Rotem, San Diego, Calif.

[73] Assignee: FDX Patents Holding Company, N.V., La Jolla, Calif.

[21] Appl. No.: 428,624

[22] Filed: Sep. 30, 1982

[51] Int. Cl.[3] ..... C22F 1/08; C22C 9/06

[52] U.S. Cl. ..... 148/411; 148/12.7 C

[58] Field of Search ..... 148/11.5 C, 12.7 C, 148/160, 414; 420/494, 485, 488

[56] References Cited

U.S. PATENT DOCUMENTS

| | | | |
|---|---|---|---|
| 2,275,188 | 3/1942 | Harrington | 148/12.7 C |
| 2,286,734 | 6/1942 | Harrington | 148/12.7 C |
| 2,412,447 | 12/1946 | Donachie | 148/12.7 C |
| 2,879,191 | 3/1959 | Nippert et al. | 148/11.5 |
| 3,046,166 | 7/1962 | Hartmann | 148/11.5 R |
| 3,573,110 | 3/1971 | Ence | 148/12.7 C |
| 3,717,511 | 2/1973 | Wallbaum | 148/11.5 R |
| 3,841,921 | 10/1974 | Shapiro et al. | 148/11.5 C |
| 3,882,712 | 5/1975 | Shapiro et al. | 148/11.5 R |
| 4,179,314 | 12/1979 | Wikle | 148/12.7 C |
| 4,202,688 | 5/1980 | Crane et al. | 148/12.7 C |
| 4,394,185 | 7/1983 | McClelland et al. | 148/12.7 C |
| 4,425,168 | 1/1984 | Goldstein et al. | 148/12.7 C |

FOREIGN PATENT DOCUMENTS

| | | | |
|---|---|---|---|
| 163248 | 12/1981 | Japan | 148/414 |
| 644868 | 1/1979 | U.S.S.R. | 148/11.5 C |

OTHER PUBLICATIONS

Fourth Internat'l. Conference on the Strength of Metals and Alloys Proceedings, "Thermo-Mechanical Treatments . . . ", vol. 2, pp. 684–688, (Aug.–Sep. 1976).

*Primary Examiner*—Peter K. Skiff

*Attorney, Agent, or Firm*—Schwartz, Jeffery, Schwaab, Mack, Blumenthal & Evans

[57] ABSTRACT

A method for enhancing the strength and hardness properties of a starting copper alloy having a matrix structure which has been cold worked and heat treated. The method includes the step of additional cold working followed by additional heat treating to increase the strength of the alloy without significantly affecting the electrical conductivity of the alloy. The method produces a strong and highly conductive material suitable for use as a field magnet which must experience high operational stress while carrying large current loads. The starting alloy may be a copper-beryllium-nickel alloy.

25 Claims, 9 Drawing Figures

SAMPLE c

SAMPLE b-3

SAMPLE b-4

THERMAL-MECHANICAL TREATMENT FOR COPPER ALLOYS

BACKGROUND OF THE INVENTION

1. Field of the Invention

The present invention relates to an improved process for the thermomechanical treatment (TMT) of copper alloys and more particularly to a TMT of copper alloys to increase the strength of the alloy and maintain high electrical conductivity.

2. Description of the Prior Art

Copper has long been known for its excellent electrical conductivity properties. The requirement for excellent conductivity in environments of moderate elevated temperature and mechanical stress has required the utilization of copper base alloys which are formed by the addition of alloying elements such as, for example, beryllium, nickel, cobalt and zirconium. Typically, alloy strengthening procedures start with a solution heat treatment which reduces the electrical conductivity prior to the precipitation hardening which is aimed to improving the material strength characteristics. Electrical properties may be improved somewhat by precipitation hardening of the alloy by removing the alloying elements' atoms from the copper over-saturated matrix.

The prior art alloying process may be explained in reference to a commercially available Cu-Be-Ni alloy UNS C17510. In accordance with ASTM Standard B534-82, UNS C17510 has the following composition:

TABLE A

| Element | Wt % |
|---|---|
| Beryllium | 0.2–0.6 |
| Cobalt | 0.3 max |
| Nickel | 1.4–2.2 |
| Nickel & Beryllium & Copper | 99.5 (min) |
| Iron | 0.10 (max) |

The material in the solution hardened and aged condition exhibits an ultimate tensile strength of on the order of 110–140 ksi (kilopounds per square inch), a 0.2% yield strength of on the order of 100–120 ksi, a tensile elongation of about on the order of 5–20%, a hardness ($R_B$) of about on the order of 95–102 and an electrical conductivity (%IACS) of about on the order of 58%.

Typically, the alloy is first solutionized (annealed) at a temperature of about 900° F. (1650° C.) and is then quenched in water at room temperature. This treatment puts the material in the A (known as TBOO according to ASTM 601 standard) temper. In the process of solutionizing, a solid state solution is formed such that the Ni, Be and other elements are uniformly distributed by atom diffusion in the copper matrix. The quenching "freezes" the atoms in their distributed state. This atomic alignment is, however, unstable since it is oversaturated. Moreover, the material is soft, and therefore, it is cold worked, such as by cold rolling. For example, in the common full hard condition the material is cold worked to reduce its thickness by 37% to put it in what is known as the H (TDO4) condition. Then the alloy can be precipitation hardened (aged) to put it in the HT (THO4) condition. The most common aging treatment is 3 hours at 482° C. (900° F.), but may also be from 2–72 hours at temperatures 300°–500° C. (570°–930° F.).

The desired hardening of the alloy as a result of this treatment results from precipitation hardening of the $NiBe_2$ intermetallic phase compounds (IC) formed out of the supersaturated solid solution of Be and Ni in copper that was freezed by the water quench from the solutionizing temperature. The resulting IC precipitates are very hard, very small and strong. This improvement in strength is achieved without significant brittleness. The alloy is usually solutionized at 900° C. (1650° F.) when supplied by commercial vendors, and may be referred to as 1650 HT. However, it can also be solutionized at higher temperatures such as 955° C. (1750° F.) to give a higher strength with an accompanying small drop in ductility and electrical conductivity. The higher strength results from the higher temperature which will put more IC atoms in solid solution. This higher solutionizing temperature variation of UNS C17510 will hereinafter be referred to as 1750 HT. In both cases the alloy is also specified by the composition Cu-0.4 Be-2Ni.

Several prior art references relate to the treatment of copper alloys. For instance, U.S. Pat. No. 4,179,314 to Wikle relates to the thermal treatment of Be-Cu alloys to optimize conductance and mechanical properties at elevated temperatures. The treatment taught by Wikle comprises the sequence of annealing followed by quenching, then cold working and a second optional annealing followed again by quenching and cold working. Next is an initial age hardening treatment, a secondary age hardening treatment, if necessary, straightening the alloy, and then stress relieving the straightened alloy. The treatment of Wikle is used to provide shaped beryllium-copper alloys useful in fabricating rotor wedges for electrical generators which retain optimum notched stress rupture resistance and thermoelectrical conductivity at high operating speeds and temperatures.

U.S. Pat. No. 3,573,110 to Ence discloses a process for obtaining high conductivity copper based alloys in which the alloy is heated at 700°–1000° C. for at least one half hour, hot rolled, cooled to below 300° C. at a rate of greater than 550° C./hour, cold rolled below 200° C. and then aged at 250°–575° C. for at least one hour.

Nippert et al, in U.S. Pat. No. 2,879,191 disclose a method of producing heat treated copper zirconium alloys for notched articles such as electrical conductors, commutators or the like that are stronger in the traverse-to-cold-working direction than in the parallel-to-cold-working direction so that the articles are not weakened by the presence of the notches.

Other examples of TMT of copper alloys are taught in:

U.S. Pat. No. 3,882,712 to Shapiro et al.,

U.S. Pat. No. 3,717,511 to Wallbaum,

U.S. Pat. No. 3,046,166 to Hartmann.

Rosen and Atzmon, in an article entitled *Thermo-Mechanical Treatments of* 18 *Ni* (300) *Maraging Steel,* discuss an investigation on the effect of thermomechanical treatments on the tensile properties of steel under various conditions such as solution treatment, aging and overaging. Experiments are reported involving aging, rolling and reaging to determine the effects of various parameters on hardness, tensile properties and the amount of reverted austenile. Consideration is not given, however, to the TMT of copper alloy to enhance its strength without degrading its conductivity properties.

The prior art teachings are not directed toward the fabrication of a high strength, high conductivity copper alloy suitable for use in a high field fusion reactor such as disclosed in U.S. Pat. No. 4,363,775 entitled Controlled Thermonuclear Fusion Device and Method, incorporated herein by reference. For such use, the copper alloy of the toroidal field coils are exposed to large operating stresses and must carry high current densities. It is desirable to fabricate a suitable high strength, high conductivity copper alloy from commercially available starting materials. Such an alloy may be a Cu-Be-Ni alloy from commercially available UNS C17510 starting materials such as 1650 HT or 1750 HT. The prior art fails to teach how such improved strength and high conductivity copper alloys can be made.

SUMMARY OF THE INVENTION

Accordingly, it is an object of the invention to provide a TMT for cold worked and aged starting materials.

It is a further object of the invention to provide a TMT for cold worked and aged copper alloy starting materials.

Another object of the invention is to provide a method for taking advantage of UNS C17510's strengthening mechanism, good formability properties and low strain hardening coefficient to produce a strong, conductive material.

A further object of the present invention is to use a TMT using various amounts of cold working with a subsequent aging step using various age-hardening temperatures and times.

Another object of the invention is to provide a high strength, high conductivity copper alloy suitable for use in toroidal field coils of a magnetically confined fusion reactor or fusion power generator.

It is a still further object of the present invention to provide additional TMT to UNS C17510 to create a very fine grain structure whereby a uniform and denser dislocation structure will be formed and to resolutionize a larger amount of Ni and Be into the copper matrix whereby upon re-aging the alloy, additional precipitation of Be and Ni will occur within the uniform and dense dislocation structure.

It is a still further object of the invention to form fine, uniformly dispersed, precipitates in a copper alloy to act as dislocation obstacles and/or barriers for strengthening the alloy beyond its initial strength.

It is a still further object of the present invention to precipitate Ni and Be out of a solid Cu solution in order to yield a purer copper matrix which will have an electrical conductivity approximately equal to the original 1650 HT or 1750 HT material.

It should be understood that the 1650 HT and 1750 HT conditions are not the only starting conditions useful with the present invention which includes additional cold work and aging of copper alloy. The HT condition is essentially an overage condition, meaning the hardness had decreased a bit from its peak value. Starting with a different heat treatment can, for certain applications, be very desirable. Examples are AT material (solutionized and aged) which would have a less dense dislocation structure but still have the developed precipitation substructure. Another example would be a less than fully-overaged condition of material with cold worked levels ranging from A to H (i.e., from none to fully hardened). For example, instead of aging at 480° C. for 2–3 hours, 3 hours at 320° C. can be used to create a fine, uniform structure of precipitates.

It is to be noted that for the starting material, such as UNS C17510, small amounts of impurities and other alloying additions may be permitted provided they do not greatly adversely affect the high strength/conductivity properties of the final alloy. In the examples herein small amounts of silicon are sometimes present in the amount of ca. 0.1%. Further, in the examples herein Cu alloys were utilized as starting materials containing essentially beryllium, nickel and cobalt. However, the invention may also be practical with other alloy compositions, such as the examples shown in U.S. Pat. No. 4,179,314, incorporated herein by reference. More generally, the invention may be practical with any alloying composition where copper is present in the amount of at least 90% by weight, and more preferably at least 95% by weight and most preferably at least 97% by weight.

The method of the present invention enhances the strength and hardness properties of a starting copper alloy having a copper matrix structure which has been cold worked and aged and comprises subjecting the starting alloy to additional cold rolling, preferably on the order of 30–80% reduction, followed by additional aging, preferably at a temperature ranging from about on the order of 300°–460° C. and for a time duration of about on the order of 1–72 hours.

The starting alloy may be a Cu-Be-Ni alloy HT tempered such as UNS C17510 or more preferably 1750 HT temper alloy.

It is believed that the additional cold working, such as cold rolling, improves the strength characteristics of the alloy because of (1) the creation of a new, very fine grain structures, (2) the formation of uniform and more dense dislocation structures and (3) the resolutionization of a certain amount of the alloying ingredients, such as nickel and beryllium, into the copper matrix. The fine, uniformly dispersed precipitates act as dislocation barriers to strengthen the material beyond the initial strength level. Upon re-aging the alloy, the additional precipitation of the alloying ingredients, such as beryllium and nickel, occurs upon the uniform and dense dislocation structure. This precipitation of the alloying ingredients, such as beryllium and nickel, out of the solid solution results in a "cleaner" and more pure copper matrix. The electrical conductivity can then be increased to approximately equal to that of the original starting material.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The accompanying drawings, which are incorporated in and form a part of the specification, illustrate several embodiments of the present invention and, together with the description, serve to explain the principles of the invention. In the drawings.

DETAILED DESCRIPTION OF THE PREFERRED EMBODIMENT

By aging an oversaturated solid solution of the Cu alloy in accordance with the invention, small and hard IC precipitates are being dispersed in the Cu matrix. Material that is in the HT condition has typically been solutionized to spread the atoms out uniformly, cold rolled and then aged.

It has now been found that additional cold rolling followed by additional aging will impart several desirable characteristics to copper alloys. The additional cold rolling imparts added strength, but, in part due to the resolutionization of the IC's, the conductivity properties of the alloy are degraded. The subsequent aging precipitates additional IC's from solution making the copper matrix purer, and thus recovers a part of the electrical conductivity.

EXAMPLE I

It has been found that the Cu-Be-Ni alloy 1750 HT can be cold rolled while in the HT (initial cold roll and then aged) temper to various levels of cold reduction and then age hardened again, i.e., double HT tempered. This special TMT results in increasing the strength of the alloy up to 28% depending on the starting material's condition, amount of cold work, and the final aging treatment. This increase in strength is accomplished with only a relatively small decrease in tensile elongation (ductility) and electrical conductivity of the alloy.

The process includes cold rolling the copper alloy up to as much as 80% cold reduction, without any intermediate annealing or any other stress relieving treatment. Due to this addition cold work, the alloy's strength (both yield and ultimate) increases. However, the tensile elongation and electrical conductivity decreases. The decrease in electrical conducitivity is due to the Ni and Be being put back into solid solution by the additional cold reduction.

The 1750 HT alloy 0.5 inch plate was supplied by Brush-Wellman, Inc. of Elmore, Ohio, and has the following composition (all percentages by weight):

| | |
|---|---|
| Be | 0.38% |
| Ni | 1.67% |
| Si | 0.01% |
| Cu | Balance |

Figure 1:
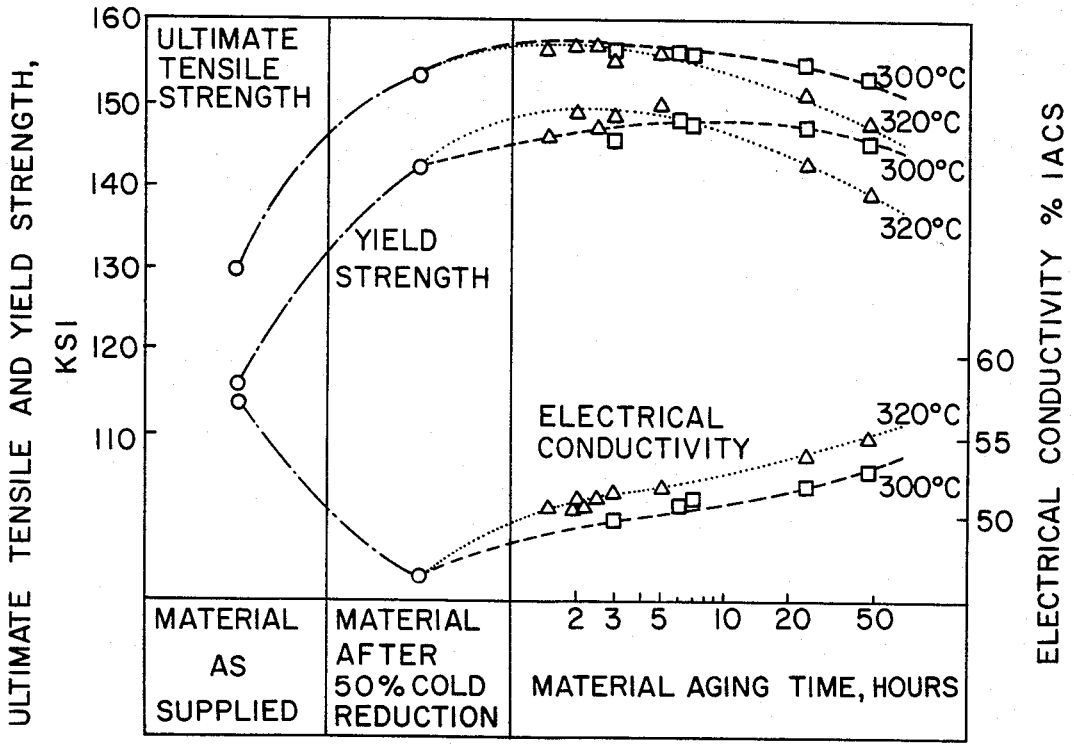
FIG. 1 is a graph depicting strength and electrical conductivity results for 1750 HT starting material after 50% cold reduction.
Figure 2:
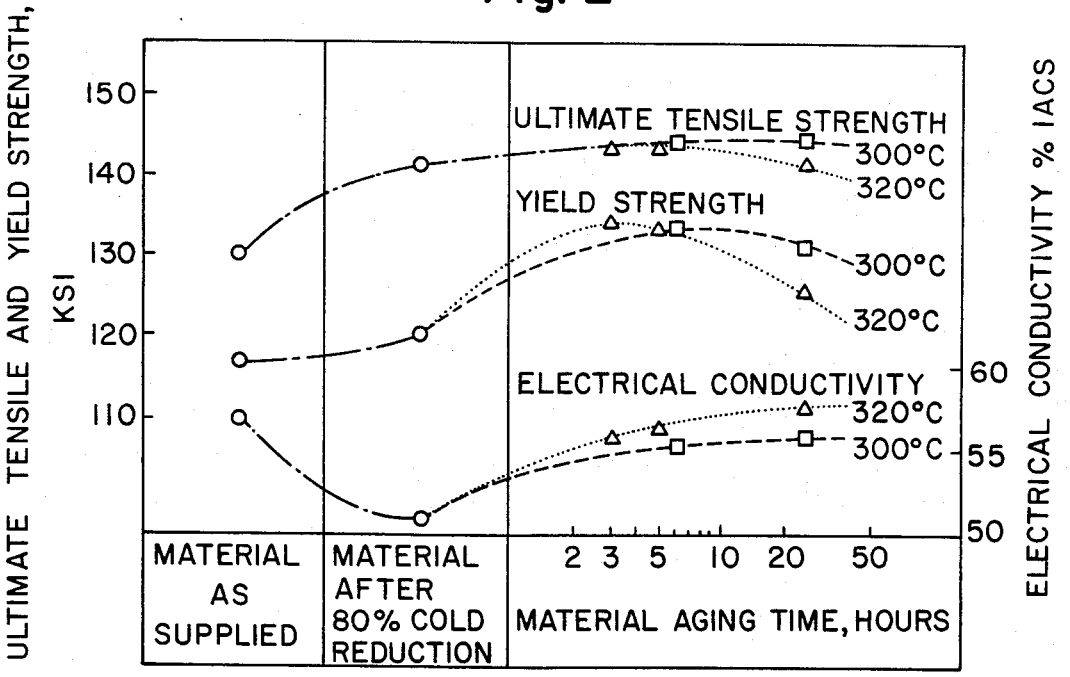
FIG. 2 is a graph depicting strength and electrical conductivity results for 1750 HT starting material after 80% cold reduction.

FIGS. 1 and 2 are graphs of the ultimate tensile strength, yield strength and electrical conductivity of Cu-Be-Ni 1750 HT starting material as a function of cold rolling and material aging time. FIG. 1 shows results of 50% cold reduction, and FIG. 2 shows results for 80% cold reduction. For each material property, curves were generated to illustrate the effects of aging at 300° C. and at 320° C. Table 1 corresponds to FIG. 1, and Table 2 corresponds to FIG. 2. The yield strength was determined using the back modulus, and, for each example, the initial gauge length Lo was equal to either 25.4 millimeters (for the cold rolled flat tensile specimen) or to four times the diameter (for the round specimens in the "as supplied" condition).

TABLE 1

| | | 50% Cold Reduction and Aging | | | | |
|---|---|---|---|---|---|---|
| Specimen No. | Re-Aging Treatment | Yield Strength 0.2% Offset ksi | Ultimate Tensile Strength ksi | Elongation $L_o$ = 25 mm (%) $L_o$ = 4D | Hardness (HRc) | Electrical Conductivity (% IACS) |
| | As supplied before addt'l. cold reduction | 116 | 130 | 13.2 | 103.5 $HR_b$ | 57.5 |
| 1 | As addt'lly. cold rolled 50% (no re-aging) | 120 | 141 | 13 | 31 | 51 |
| 2 | 300° C.-6 hrs | 133 | 144 | 14 | 31 | 55.5 |
| 3 | 300° C.-24 hrs | 131 | 144 | 14 | 32 | 56 |
| 4 | 320° C.-3 hrs | 134 | 143 | 14 | 32 | 56 |
| 5 | 320° C.-5 hrs | 133 | 141 | 13 | 31 | 56.5 |
| 6 | 320° C.-24 hrs | 125 | 141 | 13 | 31 | 58 |

TABLE 2

| | | 80% Cold Reduction and Aging | | | | |
|---|---|---|---|---|---|---|
| Specimen No. | Re-Aging Treatment | Yield Strength 0.2% Offset ksi | Ultimate Tensile Strength ksi | Elongation $L_o$ = 25.4 mm (%) $L_o$ = 4D | Hardness (HRc) | Electrical Conductivity (% IACS) |
| | As supplied before addt'l. cold reduction | 116 | 130 | 13.2 | 103.5 $HR_b$ | 57.5 |
| 1 | As 80% cold rolled (no-aging) | 142 | 153 | 8 | 31 | 46 |
| 2 | 300° C.-3 hrs | 145 | 156 | 7 | 34 | 50 |
| 3 | 300° C.-6 hrs | 148 | 156 | | 34 | 51 |
| 4 | 300° C.-7 hrs | 147 | 156 | 8 | 34.5 | 51.5 |
| 5 | 300° C.-24 hrs | 147 | 155 | 8 | 34 | 52 |

TABLE 2-continued

| Specimen No. | Re-Aging Treatment | 80% Cold Reduction and Aging: Yield Strength 0.2% Offset ksi | Ultimate Tensile Strength ksi | Elongation $L_o$ = 25.4 mm (%) $L_o$ = 4D | Hardness (HRc) | Electrical Conductivity (% IACS) |
|---|---|---|---|---|---|---|
| 6 | 300° C.-48 hrs | 145 | 153 | 7 | 34 | 53 |
| 7 | 320° C.-1.5 hrs | 146 | 156 | 8 | 35 | 51 |
| 8 | 320° C.-2 hrs | 149 | 157 | 8 | 34 | 51 |
| 9 | 320° C.-2.5 hrs | 146.5 | 157 | 9 | 34.5 | 51 |
| 10 | 320° C.-3 hrs | 148 | 155 | 8 | 35 | 51 |
| 11 | 320° C.-5 hrs | 149.5 | 156 | 8 | 35 | 52 |
| 12 | 320° C.-24 hrs | 142 | 151 | 8 | 34 | 54 |
| 13 | 320° C.-48 hrs | 138.5 | 147 | 9 | 33 | 55 |

It can be seen that electrical conductivity, while significantly lowered by cold rolling, is restored by re-aging and that material tensile strength and yield strength is enhanced by cold rolling and can be further enhanced by judicious selection of subsequent aging times and temperatures.

The alloy's strength (both yield and ultimate) increases an additional amount during the final aging treatment. There is only a slight increase in ultimate strength, while there is a significant increase in the 0.2% yield strength. There is a slight increase in tensile elongation due, at least in part, to stress relief that occurs during the final re-aging treatment. The electrical conductivity increases significantly due to the re-precipitation of Ni-Be particles during the final aging treatment resulting in a cleaner matrix (i.e., a purer copper).

After an additional 50% cold reduction on the 1750 HT material and re-aging for 3 hours at 320° C., the yield strength increased 15.5% (from 116 to 134 ksi). The ultimate tensile strength increased 10.5% (from 130 to 143 ksi), while conductivity dropped slightly (from 57% IACS to 56% IACS). After 80% additional cold reduction on the 1750 HT material and re-aging for 2 hours at 320° C., the yield strength increased 28.4% (from 116 to 149 ksi). The ultimate tensile strength increased 20.8% (from 130 to 157 ksi), while conductivity dropped from 57.5 to 51% IACS (See FIG. 2).

EXAMPLE II

A second example was tested using the 1650° F. HT tempered alloy UNS C17510 having the same composition as in Example I and prepared in a similar manner except that the solutionizing temperature was 1650° F. The results are set forth in Table 3 below for a 80% cold reduction.

TABLE 3

| Specimen No. | Re-Aging Treatment | 80% Cold Reduction and Aging: Yield Strength 0.2% Offset ksi | Ultimate Tensile Strength ksi | Elongation $L_o$ = 25.4 mm (%) $L_o$ = 4D | Hardness (HRc) | Electrical Conductivity (% IACS) |
|---|---|---|---|---|---|---|
| | As supplied before addt'l. cold rolling | 104.5 | 118 | 18.5 | 98 $HR_b$ | 59 |
| 1 | As 80% cold rolled (no-aging) | 127.5 | 140 | 6.1 | 28.5 | 51 |
| 2 | 300° C.-5 hrs | 135 | 140.5 | 7.2 | 31 | 56 |
| 3 | 300° C.-20 hrs | 132.5 | 138.5 | | 31 | 57 |
| 4 | 320° C.-2 hrs | 134 | 138.5 | 7 | 30.5 | 56 |
| 5 | 380° C.-3 hrs | 120.5 | 127 | 9 | 27 | 60 |
| 6 | 510° C.-1 hr | 62 | 70 | 25.8 | 82 $HR_b$ | 70 |

EXAMPLE III

A third example also utilizes a 0.5 inch plate of the same composition as Example I but does not utilize the standard, fully aged T condition (482° C.-3 hours). Instead, 1750 H specimens (solutionized at 955° C., quenched, and cold rolled, but not aged) were tested with the following initial aging treatment and a subsequent (second) cold reduction.

TABLE 4

| Specimen | FIG. | First Aging Treatment | Cold Reduction |
|---|---|---|---|
| a. | 3 | H ½ T (400° C.-3 hours) | 40% |
| b. | 4 | H ½ T (400° C.-3 hours) | 60% |
| c. | 5 | H ½ T (320° C.-2 hours) | 40% |

Figure 3:
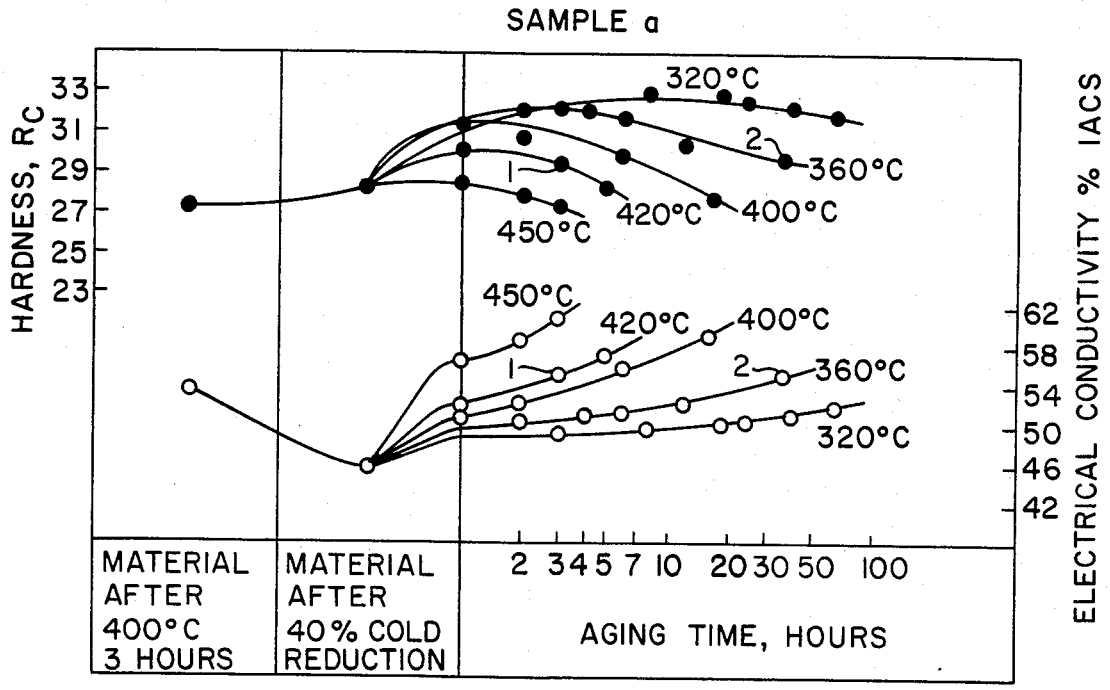
FIGS. 3 and 4 show graphs of the hardness and electrical conductivity properties for the 1750 H material after a first aging of 400° C. for 3 hours.
Figure 4:
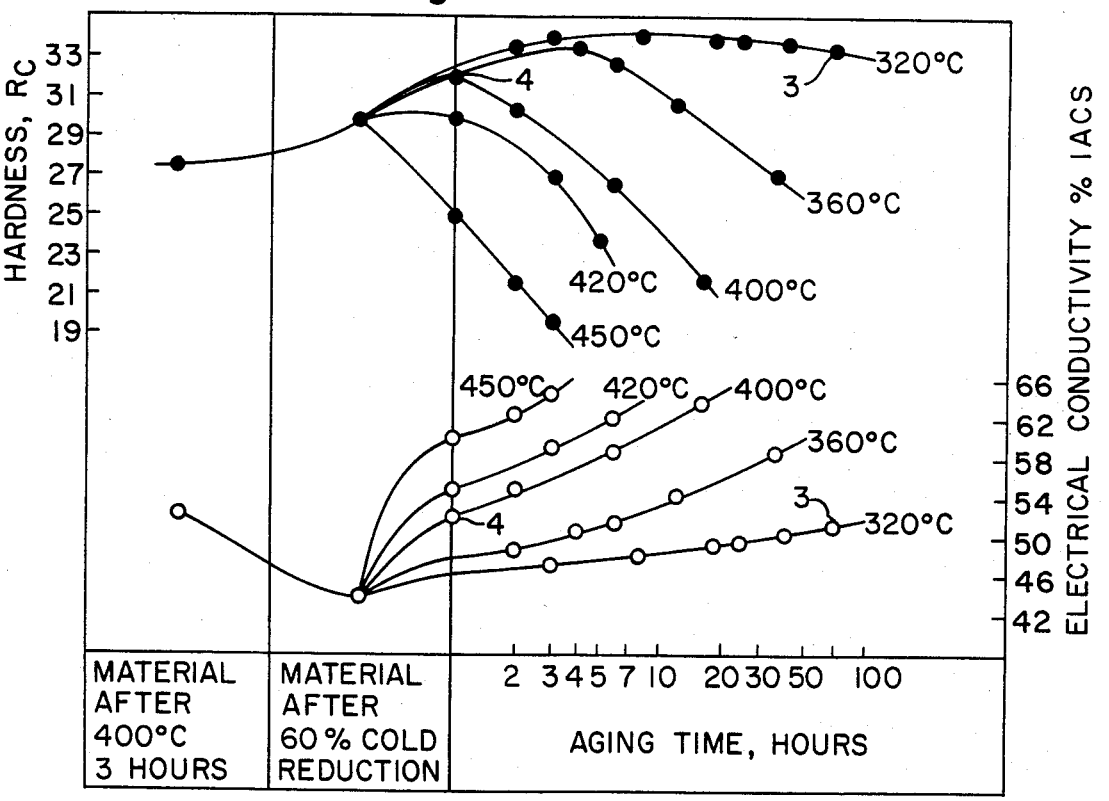
Figure 5:
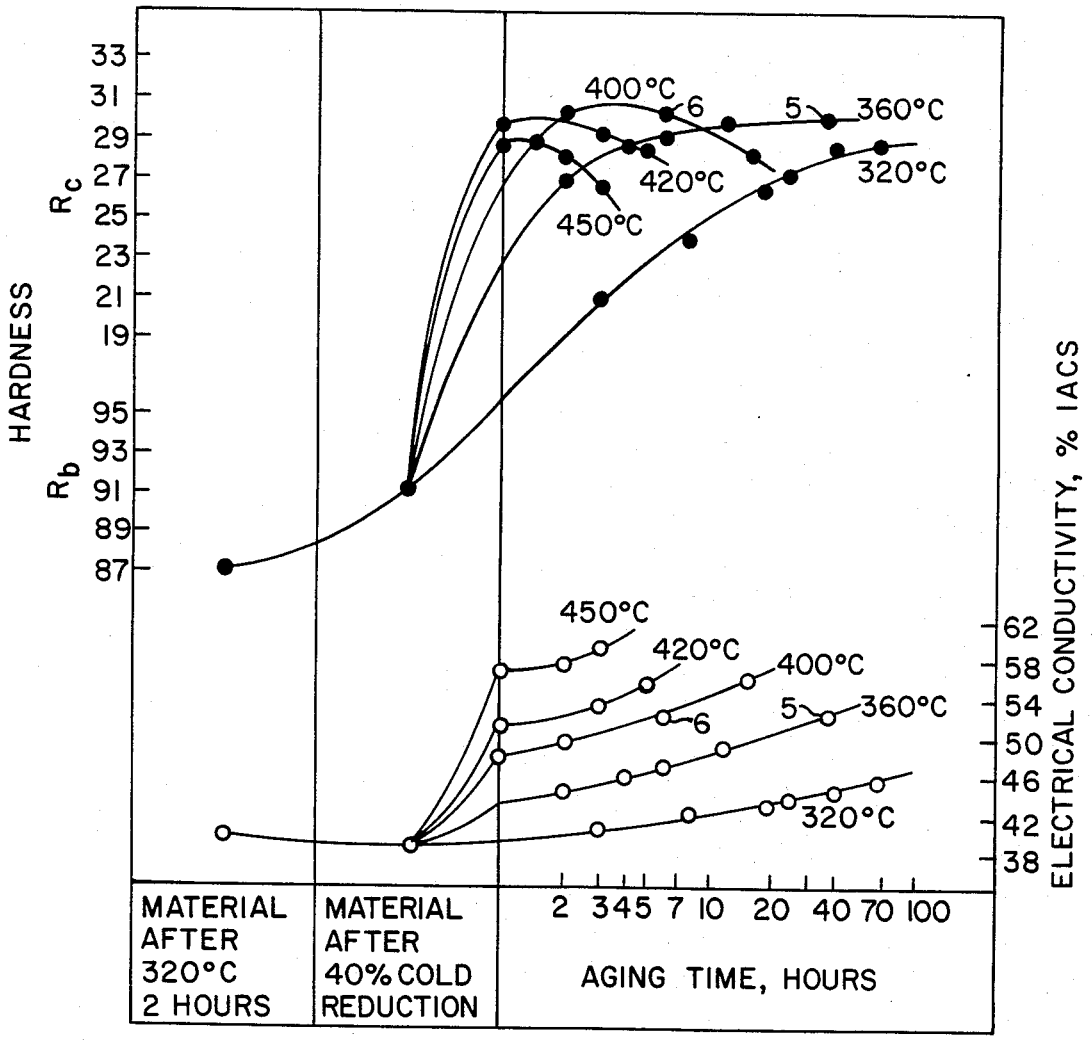
FIG. 5 shows a graph of the hardness and electrical conductivity properties for the 1750 H material after a first aging of 320° C. for 2 hours.

The resulting specimens were then subjected to an additional aging at various times and temperatures. The results for the specimens a, b and c are shown in FIGS. 3, 4 and 5, respectively. The trend generally follows that of FIGS. 1 and 2 with the second cold reduction enhancing hardness but reducing electrical conductivity. The second aging treatment reduces hardness somewhat but enhances electrical conductivity.

It may be seen that the best results are obtained with a low temperature, long aging time as a compromise between the conflicting requirements of high hardness properties and good electrical conductivity. Comparing FIGS. 3 and 4, the 60% cold reduction produces superior hardness properties at 320° C. for all aging times whereas the electrical conductivity property approaches that of the 40% cold reduced sample only after long aging times, i.e., over 20 hours, and especially at 70 hours. In comparing FIGS. 3 and 5 (the two 40% cold reduced samples) it may be seen that the use of the higher temperature, longer (first) aging time produces superior results.

Further testing of selected samples from FIGS. 3–5 were made to determine the effect of temperature on the yield and ultimate tensile strength. The selected sample points are identified in the FIGS. 3–5 by the numerals 1–6. These points were selected to test two different aging treatments from each specimen a, b and c which had nearly the same hardness and electrical conductivity. These conditions were: (1) a low temperature, long aging time and (2) a high temperature, short aging time. The tensile properties were then measured for each of the six samples as a function of temperature to see which sample was more thermally stable. The six samples may be identified as a-1, a-2, b-3, b-4, c-5 and c-6. The results of these thermal tests for samples b-3, b-4, c-5 and c-6 are shown in FIGS. 6–9. For samples a-1 and a-2, the sample plate cracked during the cold rolling (due to rolling in the transverse direction), and thus only room temperature (R.T.) results were made for both the transverse (T) and longitudinal (L) directions. The results are given as follows:

| Specimen | Sample Point | YS (ksi) | U.T.S. (ksi) | Direction |
|---|---|---|---|---|
| a | 1 | 121.6 | 134.1 | L |
| a | 1 | 124.3 | 140.9 | L |
| a | 1 | 138.5 | 143.1 | T |
| a | 2 | 135.3 | 147.4 | T |
| a | 2 | 117.1 | 137.9 | L |

Figure 6:
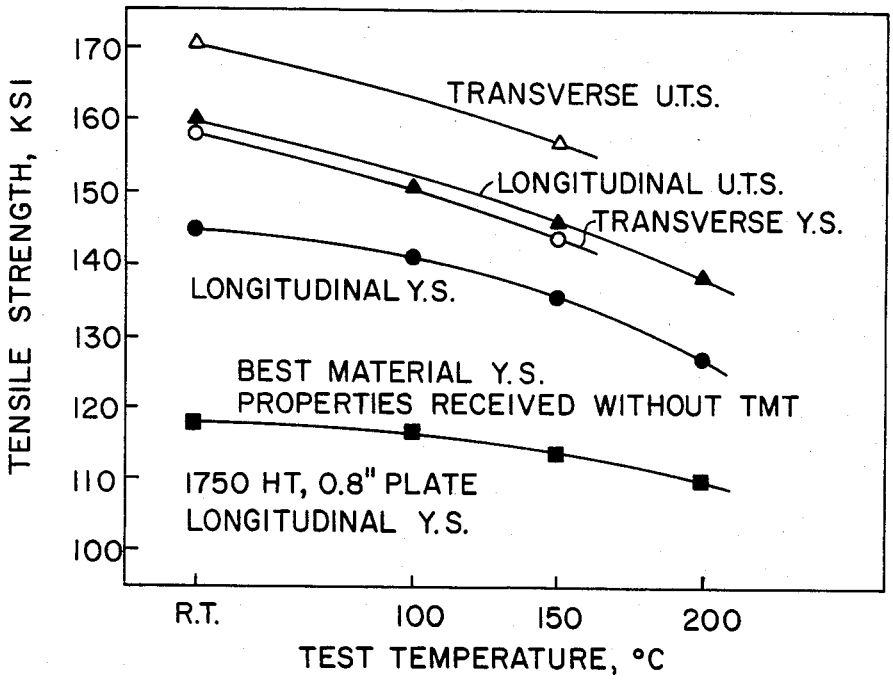
FIGS. 6–9 illustrate temperature test results for the tensile strength of the examples of FIGS. 3–5, showing that material after the TMT exhibit relatively high tensile properties even at elevated temperatures illustrating the thermal stability of the material.
Figure 7:
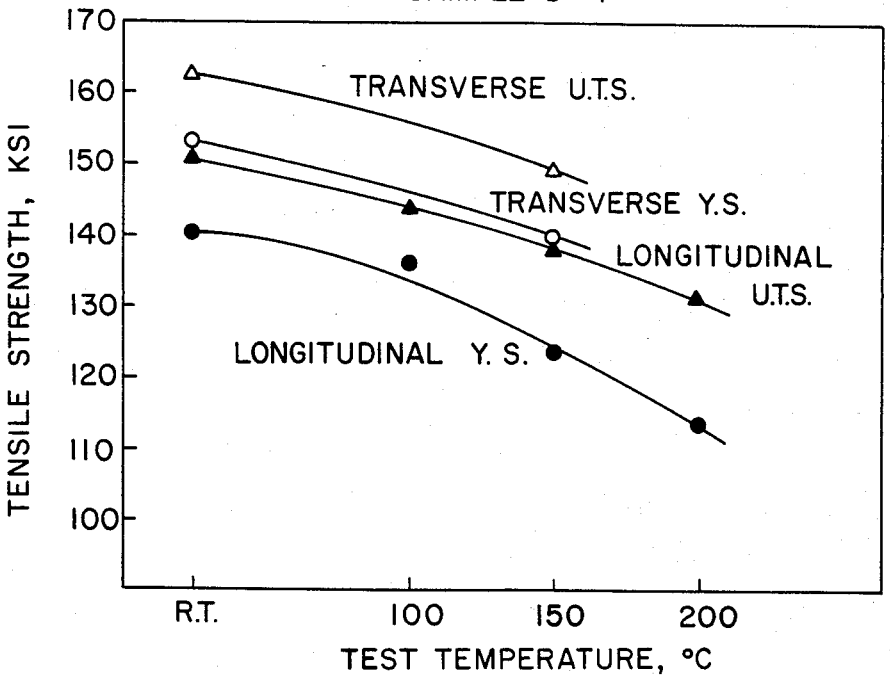
Figure 8:
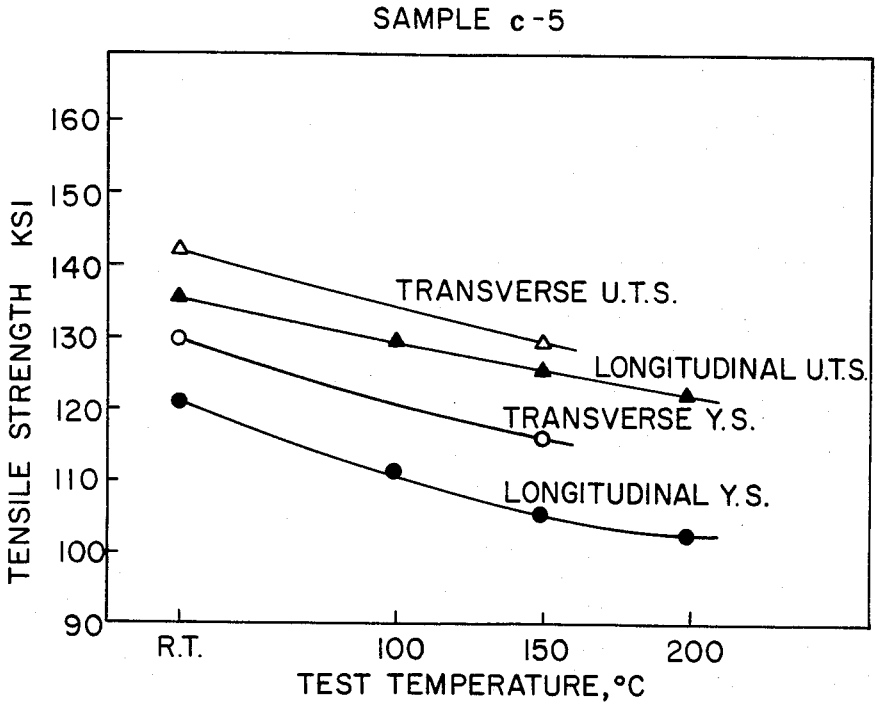
Figure 9:
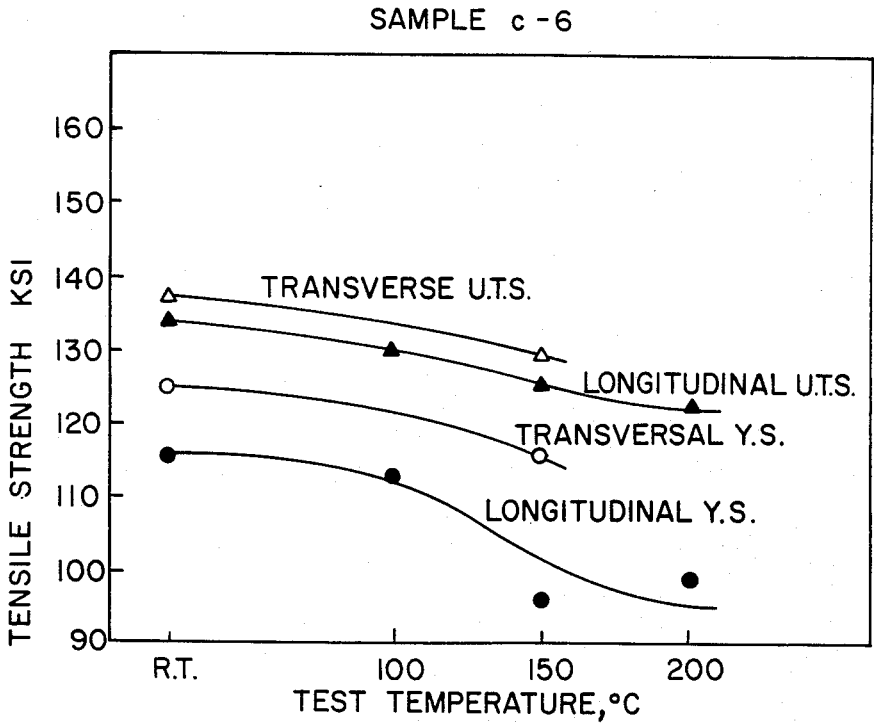

FIGS. 6–9 show the remaining results for samples taken from both transverse and longitudinal directions. In all but one case, the tensile strength is higher in the transverse than in the longitudinal direction by as much as 20%. The best tensile results were exhibited by sample b-3 (TMT 400° C.-3 hours+60% cold reduction+320° C.-70 hours) which measured a yield strength of 158.4 ksi at R.T. and 144.6 ksi at 150° C., only a 8.7% drop. This small reduction closely approaches the thermal stability of the original 1750 HT condition, 0.5 inch plate with yield strength of 117 ksi at R.T. and 110 ksi at 150° C. which is a 6% drop in strength. A 0.8 inch plate gave slightly better results than the 0.5 inch plate with yield strength of 118 ksi at R.T. and 114 ksi at 150° C., a 3.4% drop. The yield strength values for the 1750 HT condition are shown in FIG. 6 for comparison.

The foregoing description of a preferred embodiment of the invention has been presented for purposes of illustration and description. It is not intended to be exhaustive or to limit the invention to the precise form or process disclosed, and obviously many modifications and variations are possible in light of the above teaching. The embodiment of the treatment and the material were chosen and described in order to best explain the principles of the invention and its practical application, to thereby enable others skilled in the art, to best utilize the invention in various embodiments and with various modifications as are suited to the particular use contemplated. It is intended that the scope of the invention be defined by the claims appended hereto.

What is claimed is:

1. A method of enhancing the strength and hardness properties of a starting copper alloy having a copper matrix structure containing at least one element in solution capable of being precipitated, said starting material having been cold worked and subjected to a precipitation hardening heat treatment for on the order of about 2 to 72 hours at a temperature in the range of about 300°–500° C. comprising the steps of additional cold working followed by an additional precipitation hardening heat treatment to produce a material having a tensile strength of at least 150 ksi and a tensile ductility of at least 5%, said copper alloy consists essentially of the composition by weight of beryllium: 0.2–0.6
cobalt: 0.3 maximum
nickel: 1.4–2.2
nickel, beryllium & copper: 99.5 minimum
iron: 0.1 maximum.

2. The method of claim 1, wherein the copper alloy is UNS C 17510.

3. The method of claim 1, wherein the additional cold working is sufficient to create a very fine grain structure in the copper alloy.

4. The method of claim 3, wherein the additional cold working is further sufficient to re-solutionize alloy materials into said copper matrix.

5. The method of claim 2, wherein said starting alloy has been HT tempered sufficiently to decrease its hardness and to develop a precipitation sub-structure.

6. The method of claim 2, wherein said starting alloy is HT tempered and is solutionized at one of 1650° F. and 1750° F.

7. The method of claim 4, wherein the additional cold working includes cold rolling the alloy to reduce its thickness up to on the order of about 80%.

8. The method of claim 4, wherein the additional cold working includes cold rolling the alloy to reduce its thickness up to on the order of about 50%.

9. The method of claim 4, wherein the additional cold working includes cold rolling the alloy to reduce its thickness up to on the order of about 35% without any intermediate stress relieving treatment.

10. The method of claim 1 or 2, wherein the additional precipitation hardening heat treatment step produces a strong and highly conductive material.

11. The method of claim 4, wherein the additional precipitation hardening heat treatment is sufficient to precipitate said alloy materials of said copper matrix in order to yield purer copper having a higher electrical conductivity.

12. The method of claim 10 wherein the additional cold working and precipitation hardening heat treatment is sufficient to increase the strength of the alloy by on the order of about 28% without significantly effecting the tensile elongation or electrical conductivity of said alloy.

13. The method of claim 11, wherein the additional precipitation hardening heat treatment occurs at a temperature of on the order of about 280° C. to 600° C.

14. The method of claim 11, wherein the additional precipitation hardening heat treatment occurs at a temperature of on the order of oubt 300° C. to 460° C.

15. The method of claim 13 or 14, wherein the additional precipitation hardening heat treatment occurs for a time duration of at least on the order of ½ hour.

16. The method of claim 13 or 14, wherein the additional precipitation hardening heat treatment occurs for a time duration of on the order of about ½–168 hours.

17. The method of claim 13 or 14, wherein the additional precipitation hardening heat treatment occurs for a time duration of on the order of 1–72 hours.

18. A method of improving the strength and electrical conductivity properties of a precipitation hardenable copper alloy comprising the steps of:

(a) providing said copper alloy which consists essentially of the composition by weight of:
beryllium: 0.2–0.6
cobalt: 0.3 maximum
nickel: 1.4–2.2
nickel, beryllium & copper: 99.5 minimum
iron: 0.1 maximum
(b) solutionizing the alloy;
(c) quenching the solutionized alloy;
(d) cold working the quenched alloy;
(e) precipitation hardening the cold worked alloy for on the order of about 2–72 hours at a temperature in the range of about 300°–500° C.;
(f) additionally cold working the precipitation hardened alloy; and
(g) additional precipitation hardening the additionally cold worked alloy to produce a material having a tensile strength of at least 150 ksi and a tensile ductility of at least 5%.

19. The method as recited in claim 18, wherein said additional cold working includes a 40%–80% cold reduction.

20. The method as recited in claim 18 or 19, wherein said additional precipitation age hardening step includes heating for a time between ½ and 70 hours.

21. The method as recited in claim 18, wherein the precipitation hardening step (e) comprises heating said cold worked alloy at a temperature of about 482° C. for 3 hours.

22. The method as recited in claim 18, wherein the precipitation hardening step (e) comprises heating said cold worked alloy at a temperature of 400° C. for 3 hours; and the additional cold working step (f) comprises cold rolling said alloy to 60% cold reduction and the additional precipitation hardening step (g) comprises heating said alloy at about 320° C. for at least about 20 hours.

23. A precipitation hardenable copper alloy having a tensile strength of at least 150 ksi and a tensile ductility of at least 5% produced by a method comprising the steps of:

(a) providing a copper alloy which consists essentially of the composition by weight of:
beryllium: 0.2–0.6
cobalt: 0.3 maximum
nickel: 1.4–2.2
nickel, beryllium & copper: 99.5 minimum
iron: 0.1 maximum
(b) solutionizing the alloy;
(c) quenching the solutionized alloy;
(d) cold working the quenched alloy;
(e) precipitation hardening the cold worked alloy for on the order of about 2–72 hours at a temperature in the range of about 300°–500° C.;
(f) additionally cold working the precipitation hardened alloy; and
(g) additionally precipitation hardening the additionally cold worked alloy.

24. The copper alloy of claim 23 wherein said additional age hardening includes heating for a period of time between ½ and 70 hours.

25. The copper alloy of claim 23 wherein the alloy has an electrical conductivity of greater than 50% IACS.

* * * * *